United States Patent [19]

Crowley, Jr.

[11] Patent Number: 4,615,367

[45] Date of Patent: Oct. 7, 1986

[54] BACKHOE LOG SPLITTER

[76] Inventor: John C. Crowley, Jr., 2828 Keech Rd., R.D. #1, Branchport, N.Y. 14418

[21] Appl. No.: 753,238

[22] Filed: Jul. 9, 1985

[51] Int. Cl.[4] ..... B27L 7/00

[52] U.S. Cl. ..... 144/366; 144/193 A

[58] Field of Search ..... 144/193 A, 193 R, 3 K, 144/366

[56] References Cited

U.S. PATENT DOCUMENTS

| | | | |
|---|---|---|---|
| 4,019,549 | 4/1977 | Williams | 144/193 A |
| 4,380,258 | 4/1983 | Hanser | 144/193 A |
| 4,444,231 | 4/1984 | Dillon | 144/193 A |
| 4,501,309 | 2/1985 | Sinden | 144/193 A |

*Primary Examiner*—W. D. Bray

*Attorney, Agent, or Firm*—Stonebraker, Shepard & Stephens

[57] ABSTRACT

Log splitting pincers 20 are mounted on the bucket pivot 17 of a dipperstick 12 of a backhoe 10 in place of a backhoe bucket and are operated by the hydraulic curl actuator 16 of dipperstick 12 for splitting logs. Pincers 20 include a wedge 30 braced and fixed to the boom side of dipperstick 12 and a pusher 40 operated by bucket linkage 15 and 16 in a curl motion toward and away from wedge 30. Pusher 40 has a curved surface confronting wedge 30 for engaging an end of a log to be split and driving the log onto wedge 30. A backhoe operator can maneuver dipperstick 12 and log pincers 20 to orient, lift, and split logs without any manual handling of the logs.

38 Claims, 9 Drawing Figures

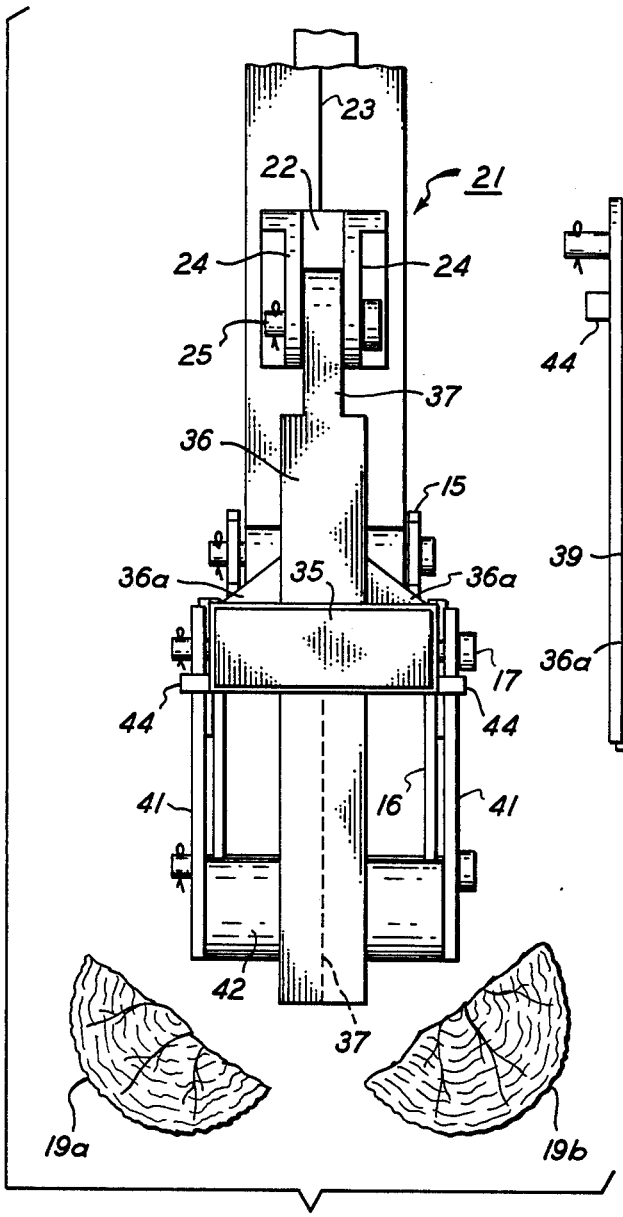
FIG. 4
FIG. 8
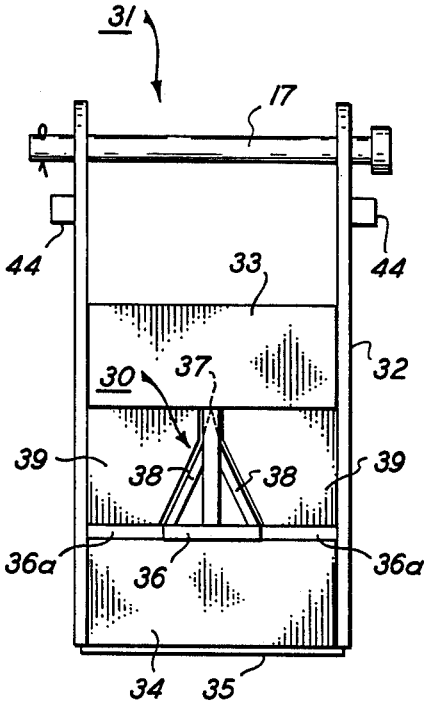
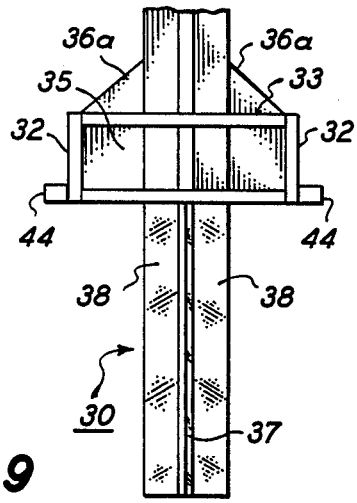
FIG. 9

BACKHOE LOG SPLITTER

BACKGROUND

Hydraulic log splitters generally use splitting devices committed to work along a predetermined path to which unsplit logs must be lifted or maneuvered and from which split logs must be cleared. This involves manually moving logs into the splitting path, which is not only laborious, but also dangerous, because the log mover's hands work close to the splitting mechanism.

Backhoes, with their built-in hydraulics, have been adapted for wood splitting, but the adaptations have still committed the splitting device to a predetermined path to which logs must be manually moved. To avoid going back and forth between the backhoe controls and the splitting station, such arrangements also require a backhoe operator assisted by another worker who moves logs and works dangerously near the splitter.

I have devised a way of mounting wood splitting pincers on the dipperstick of a backhoe so that an unassisted backhoe operator can maneuver the dipperstick and pincers to split logs any where within the reach of the dipperstick. By using the powered maneuverability of the backhoe, an operator using my invention can select logs to be split, move or orient the logs into positions suitable for splitting, and move or lift the logs to a splitting position different from where the unsplit logs were picked up. All this can be accomplished quickly and safely by one person operating backhoe controls without any risk of hands being caught in the splitting pincers.

SUMMARY OF THE INVENTION

My invention mounts a pair of splitting pincers on the free end of a dipperstick of a backhoe so that the splitting pincers can be driven by the hydraulic curl actuator of the dipperstick. An operator can then maneuver the boom and dipperstick of the backhoe to reach out to logs to be split and to orient the logs so that the splitting pincers span their length. Then by operating the curl actuator, the operator can close the splitting pincers, which include a wedge that splits the logs. This can be done where the logs lie or after the logs are picked up and moved to a splitting region.

The splitting pincers preferably mount on a bucket pivot on the dipperstick in place of a bucket for the backhoe, and the pincers preferably include a wedge fixed and braced on a boom side of the dipperstick and a pusher connected to the hydraulic curl actuator by bucket linkage for moving toward and away from the wedge in a curl motion. The pusher preferably has a rounded face confronting the wedge and moves in a curl arc downward to a plane perpendicular to the lower end of the wedge and from there upward to proximity with the wedge.

The result is a pair of powerful and maneuverable splitting pincers that can reach into a pile of unsplit logs, select and, if necessary, move a log to be split, and then split the log onto a separate pile or onto a truck or wagon. All this can be done rapidly and efficiently with no danger to the operator or anyone else.

DRAWINGS

FIG. 4 is a partially schematic, rear view of the splitting pincers of FIGS. 2 and 3 as seen by a backhoe operator with the splitting pincers in a closed position and portions of the dipperstick cut away;

Figure 2:
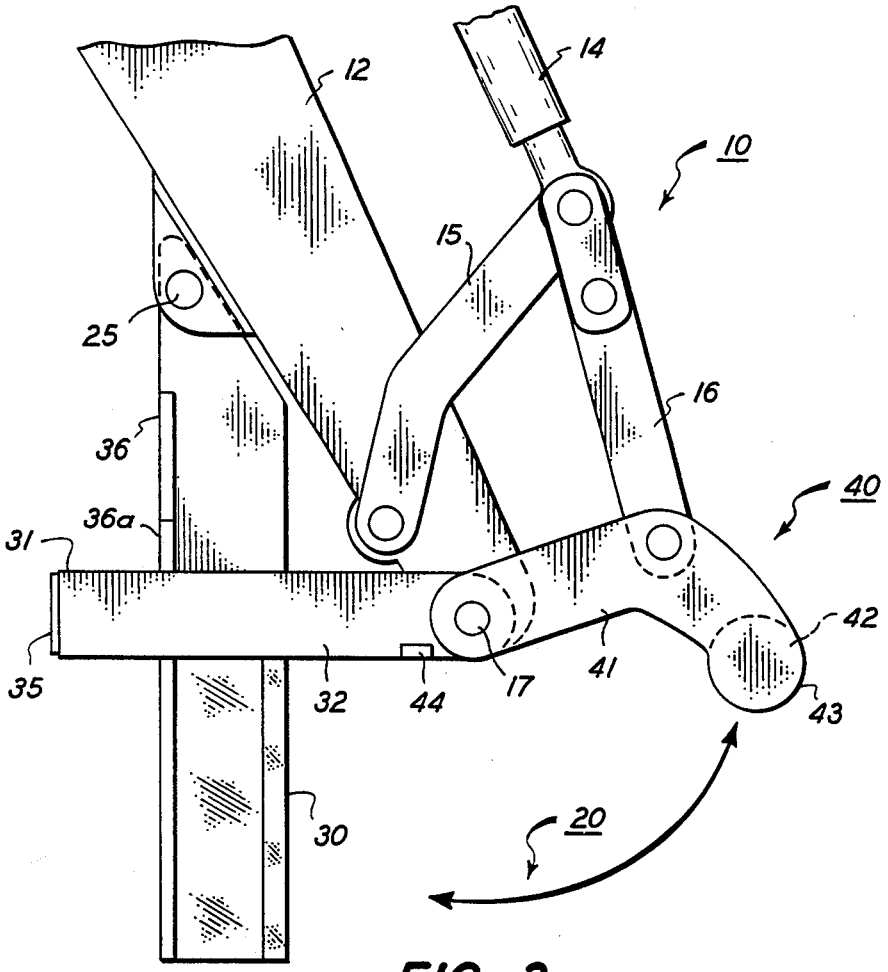
FIGS. 2 and 3 are partially schematic, side elevational views of a preferred embodiment of my log splitting pincers mounted on a free end of a backhoe dipperstick and shown open in FIG. 2 and closed in FIG. 3.
Figure 5:
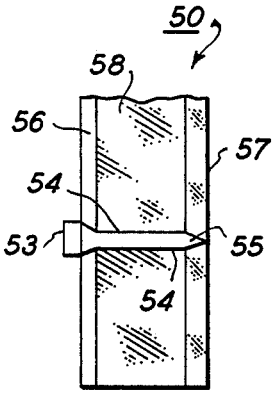
Figure 6:
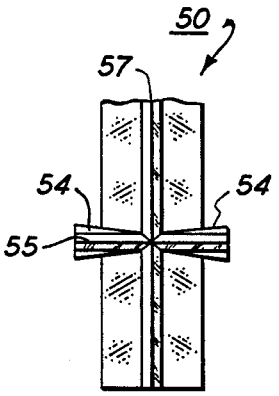
Figure 7:
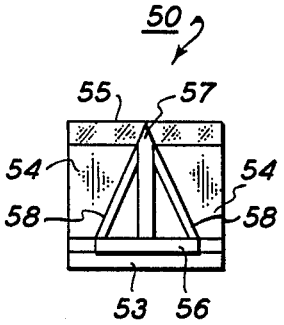
Figure 3:
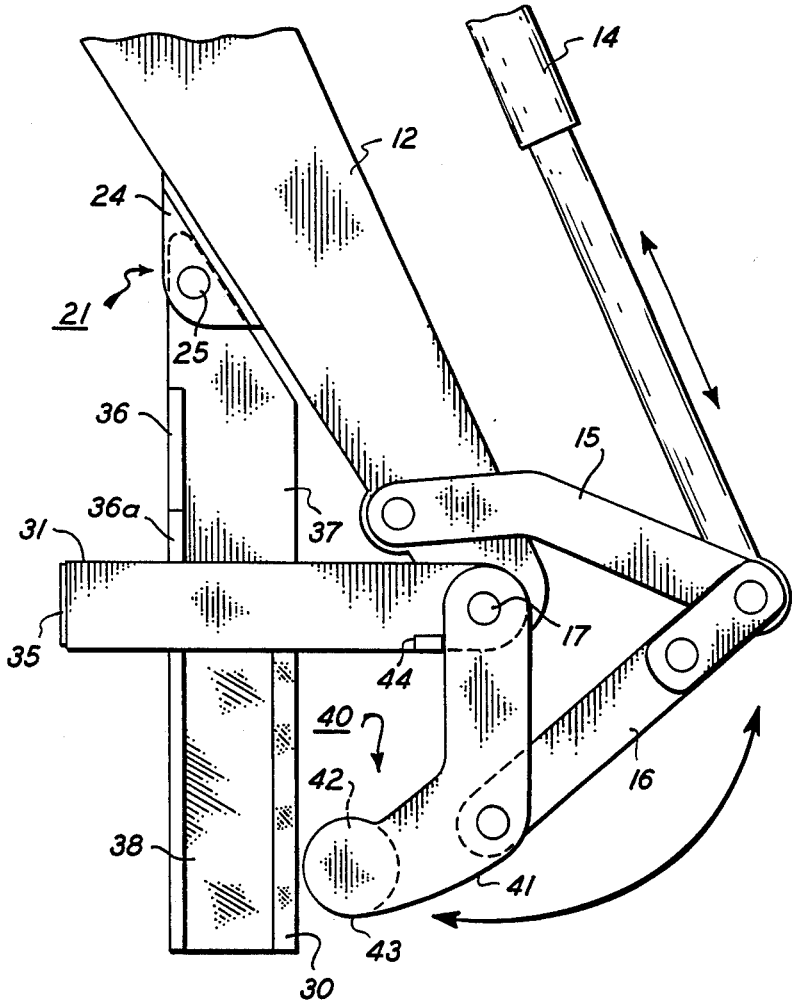

FIGS. 5, 6, and 7 are fragmentary side, front, and top views of an alternative wedge for the splitting pincers of FIGS. 2–4 for splitting logs in both horizontal and vertical planes;

FIG. 8 is a top view of a splitting wedge and brace for the splitting pincers of FIGS. 2–4; and FIG. 9 is a front view of the splitting wedge and brace of FIG. 8.

DETAILED DESCRIPTION

Figure 1:
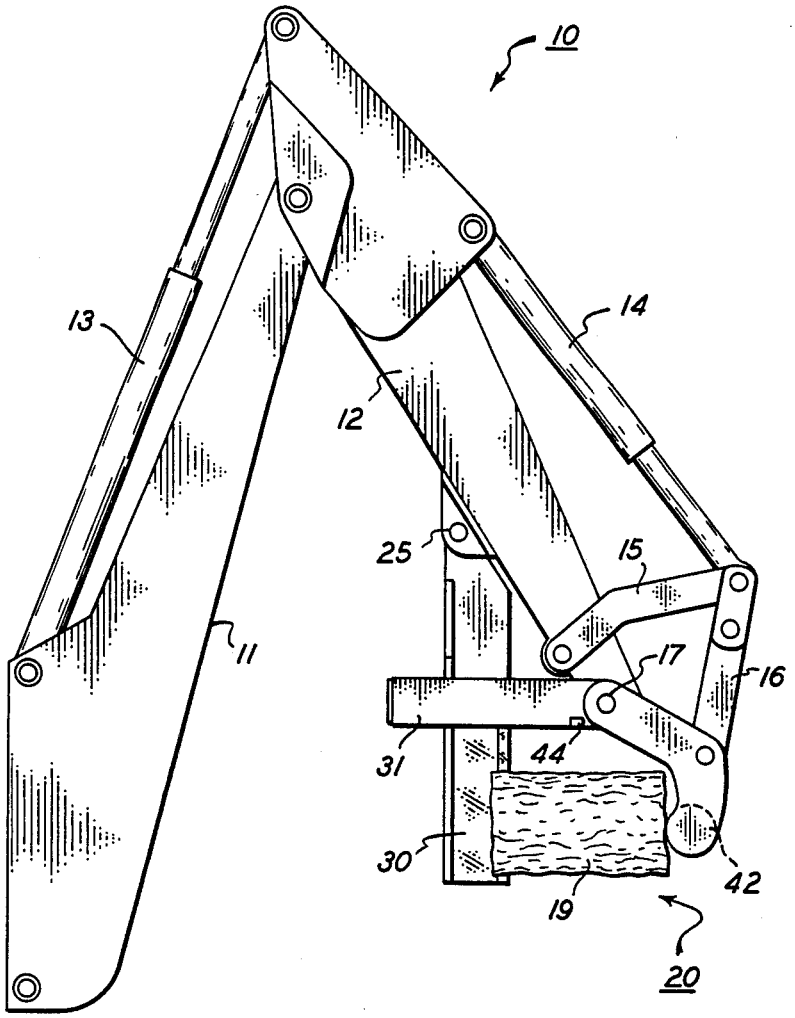
FIG. 1 is a partially schematic, side elevational view of a boom and dipperstick of a backhoe equipped with log splitting pincers according to my invention.

Backhoes that can mount my log splitting pincers can be either tractor backhoes or larger excavating backhoes. As shown in FIG. 1, a suitable backhoe 10 generally includes a boom 11 carrying a dipperstick 12. Boom 11 pivots from side to side and moves up and down and has a crowd cylinder 13 for moving dipperstick 12 toward and away from boom 11. A hydraulic curl cylinder 14, mounted on dipperstick 12, connects to and operates bucket linkage 15 and 16 to move a bucket (not shown) in a curl motion around a bucket pivot 17 at the free end of dipperstick 12. A variety of backhoe buckets can be pinned onto bucket pivot 17 and bucket linkage 16.

For splitting a log 19, I prefer removing a bucket from bucket pivot 17 and replacing the bucket with wood splitting pincers 20. Of the several possible ways of arranging wood splitting pincers on dipperstick 12 to be driven by hydraulic curl actuator 14, I prefer the arrangement shown in FIGS. 2–4. This includes a wedge 30 and a pusher 40, both mounted on bucket pivot 17, with wedge 30 fixed to the boom side of dipperstick 12 and pusher 40 driven by bucket linkage 15 and 16 in a curl arc toward and away from wedge 30. When open as shown in FIG. 2, wedge 30 and pusher 40 can span nearly two feet for straddling the length of a log to be split. As pusher 40 moves in a curl arc toward wedge 30 to the position shown in FIG. 3, it drives a log against wedge 30, which splits the log into two parts 19*a* and *b* as shown in FIG. 4.

Although it is possible to substitute a fixed support for wedge 30 and a movable wedge for pusher 40, I prefer the illustrated arrangement. A fixed wedge 30 can be made sturdy and strong without blocking much of the operator's view, and pusher 40 effectively engages and moves with the ends of logs driven onto wedge 30 as pusher 40 moves in its curl arc motion. It may also be possible, but I believe unnecessary, to arrange log splitting pincers with opposite jaws that both move under hydraulic power from curl actuator 14.

Wedge 30 is preferably supported by a brace 31 mounted on bucket pivot 17 and extending toward the operator on the boom side of dipperstick 12. Brace 31 includes a pair of spaced-apart arms 32 spanned by upper and lower pairs of cross plates 33 and 34 and a back panel 35. Wedge 30 mounts between cross plates 33 and 34 and includes a back plate 36 that is preferably about two to three inches wide and a wedge plate 37 that extends forward in T-fashion from back plate 36. Gussets 36*a* laterally strengthen the connection of back plate 36 to brace 31.

Below brace 31, wedge angle plates 38 are welded between wedge plate 37 and back plate 36, and the leading edge of wedge plate 37 is sharpened to form a smooth wedge shape for log splitting. Plates 39 at the bottom of brace 31 close the region around wedge 30 between plates 33 and 34 so that wood is kept out of brace 31.

Back plate 36 and wedge plate 37 extend above brace 31 to a region where wedge plate 37 is pinned to the boom side of dipperstick 12. For this I prefer a bracket 21 having a base plate 22 welded to the boom side of dipperstick 12 to span a welded seam 23 on dipperstick 12. Plate 22 thus spans and strengthens the region of dipperstick 12 where bracket 21 is mounted. Bracket 21 also includes an opposed pair of stand-off plates 24, each of which has a hole to receive a pin 25 that can pass through an upper region of wedge plate 37 to pin wedge 30 in place. When splitting pincers 20 are not mounted on dipperstick 12, bracket 21 remains in place and serves as a clevis supporting pin 25 for receiving a chain or cable. Bracket 21 can be made in different sizes to accommodate various backhoe dippersticks and to bridge various distances between a dipperstick and wedge plate 37.

Pusher 40 preferably has a pair of side arms 41 with holes for mounting on bucket pivot 17 and for connecting to bucket linkage 16. I prefer a length of pipe 42 welded between side arms 41 to serve as a log pusher and to present a rounded surface confronting wedge 30. The ends 43 of side arms 41 are preferably rounded to match the curvature of pipe 42. I have found that the rounded surface of pipe 42 is effective at engaging the far end of a log to be split and maintaining a sliding engagement with that end of the log while driving the log onto wedge 30. I prefer a pair of stops 44 welded to the side of brace 31 to engage the side arms 41 of pusher 40 to prevent any actual engagement of pipe 42 with the leading edge of wedge 30.

It is also possible for the wedge of splitting pincers 20 to have multiple wedges for splitting logs in more than one plane. For example, as illustrated in FIGS. 5–7, alternative wedge 50 includes both a vertical and a horizontal wedge. Wedge plate 57 and back plate 56, in cooperation with angled side plates 58, form a vertical wedge; and wedge plate 55 and back plate 53, welded behind back plate 56, form a horizontal wedge. I prefer that horizontal wedge back plate 53 be narrower than vertical wedge back plate 56 so that only a small tapered side plate or fill region 54 is necessary to form a wedge angle between wedge plate 55 and back plate 53.

Alternative wedge 50 is preferably provided with a brace 31 for pinning to dipperstick 12 in place of wedge 30 for splitting small logs into four pieces in one splitting actuation. This can speed up the work of splitting smaller logs up to about 24 inches in diameter. For larger logs that cannot be split into four pieces in a single stroke or that require splitting into more than four pieces, I prefer single wedge 30. This can split off sap wood slabs around the perimeter of large logs and reduce the heart wood to a size splittable in a single stroke.

Either wedge 30 or pusher 40 can be used to shift the positions of logs to a splittable orientation with the axis of the log extending away from the boom so that the splitting pincers can span the length of the log and split it. One end of the log can be slid sideways with wedge 30, for example, to align the log with the curl motion of pusher 40.

Splitting pincers 20 can also grip a log for lifting and moving the log. A lifted log can be split in any region and at any elevation that the backhoe can reach. This allows the split wood to be dropped onto a separate pile from the unsplit wood or to be dropped into a truck.

The curl motion of pusher 40 as shown by the arrows in FIGS. 2 and 3 preferably curves downward to a tangent with a plane perpendicular with the lower end of wedge 30 and upward from the tangency point toward proximity with wedge 30. Even though the motion of pusher 40 against the far end of a log being driven onto wedge 30 is first downward and then upward as the log advances onto wedge 30, I have found that pusher 40 slides along the far ends of logs and effectively drives logs straight onto wedge 30. If a log being split is veered off course by the movement of pusher 40 in its curl arc, it is only necessary to reverse pusher 40 slightly and momentarily for a fresh grip assuring a straight push on the log being split.

Most logs split apart before passing all the way onto wedge 30, but making pusher 40 move right up to close proximity with the leading edge of wedge 30 assures that split parts of a log do not remain connected by splinters. The length, thickness, and wedge angle of wedge 30 can be varied to suit the power of the backhoe being used. Blunt and wide wedges need more splitting power but act faster than narrower wedges.

I claim:

1. A log splitter for a backhoe having a boom and a dipperstick with a hydraulic curl actuator, said log splitter comprising:

a. a pair of splitting pincers mounted on a free end of said dipperstick to extend below said dipperstick; and b. said pincers being driven closed and open by said hydraulic curl actuator.

2. The log splitter of claim 1 wherein one of said pincers is fixed to said dipperstick, and the other of said pincers is driven by said curl actuator.

3. The log splitter of claim 2 wherein said fixed pincer is a wedge, and said driven pincer is a pusher having a rounded face confronting said wedge.

4. The log splitter of claim 3 wherein said wedge is fixed to a boom side of said dipperstick, and said pusher is operated by bucket linkage driven by said curl actuator.

5. The log splitter of claim 1 wherein said pincers are mounted on a bucket pivot on said dipperstick in place of a bucket for said backhoe.

6. The log splitter of claim 5 wherein one of said pincers is a wedge fixed to said dipperstick on a boom side of said bucket pivot, and the other of said pincers is a pusher driven by said actuator in a curl motion on said bucket pivot.

7. The log splitter of claim 6 wherein said pusher has a rounded face confronting said wedge, and a curl arc for said pusher curves downward to a plane perpendicular to a lower end of said wedge and curves upward from said plane to proximity with said wedge.

8. The log splitter of claim 7 including a brace mounted on said bucket pivot to support said wedge and a stop arranged for blocking said pusher from engaging said wedge.

9. A log splitting accessory for a backhoe having a boom and a dipperstick with a hydraulic curl actuator driving bucket linkage movable relative to a bucket pivot at a lower end of said dipperstick, said accessory comprising:

a. a pair of splitting pincers mounted on said bucket pivot in place of a bucket for said backhoe; and b. said splitting pincers being driven via said bucket linkage by said curl actuator for closing and opening said splitting pincers to split logs.

10. The accessory of claim 9 wherein said one of said splitting pincers is a wedge fixed to a boom side of said dipperstick, and the other of said splitting pincers is a pusher driven by said actuator in a curl motion toward and away from said wedge.

11. The log splitter of claim 10 wherein said wedge is shaped for splitting logs in more than one plane.

12. The log splitter of claim 10 including a bracket welded to a boom side of said dipperstick and a pin securing said wedge to said bracket.

13. The accessory of claim 10 wherein said pusher has a rounded surface confronting said wedge.

14. The accessory of claim 10 including a brace mounted on said bucket pivot and supporting said wedge.

15. The accessory of claim 14 including a bracket welded to a boom side of said dipperstick and a pin fastening an upper region of said wedge to said bracket.

16. The accessory of claim 9 wherein one of said splitting pincers is a wedge supported by a brace mounted on said bucket pivot and pinned to a boom side of said dipperstick via a bracket secured to said boom side of said dipperstick.

17. The accessory of claim 16 wherein said wedge is shaped for splitting logs in more than one plane.

18. The accessory of claim 16 wherein said bracket includes a base plate welded to said dipperstick to span a seam on a boom side of said dipperstick and an opposed pair of stand-off plates with holes for receiving said pin.

19. The accessory of claim 16 wherein another of said splitting pincers is a pusher driven by said actuator in a curl motion toward and away from said wedge.

20. The accessory of claim 19 wherein said pusher has a rounded surface confronting said wedge, and bucket linkage for said backhoe is pinned to said pusher for driving said pusher in said curl motion.

21. The accessory of claim 19 including a stop arranged on said brace for blocking said pusher from engaging said wedge.

22. The accessory of claim 10 wherein said curl motion of said pusher curves down to a plane perpendicular with a lower end of said wedge and curves up from said plane to proximity with said wedge.

23. A method of splitting logs with a backhoe having a boom and a dipperstick with a hydraulic curl actuator operable at a free end of said dipperstick, said method comprising:

a. arranging a pair of splitting pincers on said dipperstick to extend below said free end of said dipperstick; and b. opening and closing said splitting pincers with said curl actuator for splitting logs.

24. The method of claim 23 including maneuvering said dipperstick for locating said splitting pincers to span the length of a log to be split and then operating said curl actuator to close said splitting pincers and split said spanned log.

25. The method of claim 23 including arranging one of said splitting pincers as a wedge fixed to said dipperstick and driving the other of said splitting pincers with said actuator in a curl motion toward and away from said wedge.

26. The method of claim 25 including arranging said other pincer with a curved surface confronting said wedge.

27. The method of claim 26 including positioning said wedge and said other pincer so that said curl motion curves downward toward a plane perpendicular with a bottom end of said wedge and upward from said plane to proximity with said wedge.

28. The method of claim 23 including mounting said splitting pincers on a bucket pivot of said dipperstick in place of a bucket for said backhoe.

29. The method of claim 28 including connecting bucket linkage of said backhoe to said splitting pincers.

30. The method of claim 29 including making one of said pincers a wedge disposed on a boom side of said bucket pivot, pinning said wedge to said dipperstick, and pinning said bucket linkage to the other of said pincers.

31. The method of claim 30 including arranging said wedge and said other pincer relative to said bucket pivot so that said other pincer has a curved surface confronting said wedge and moving in a curl motion that curves down to a point spaced in front of said wedge and upward from said point to proximity with said wedge.

32. A log splitting method using a backhoe and comprising:

a. maneuvering a boom and dipperstick of said backhoe to position said dipperstick above a log to be split; and b. operating a hydraulic curl actuator of said dipperstick for pushing a far end of said log toward said boom to advance said log onto a wedge fixed to said dipperstick.

33. The method of claim 32 including mounting said wedge and a log pusher driven in said curl motion by said actuator on a bucket pivot of said dipperstick.

34. The method of claim 33 including pinning an upper end of said wedge to said dipperstick and connecting said pusher to bucket linkage operated by said actuator.

35. The method of claim 34 including bracing said wedge with a brace attached to said bucket pivot and curving a surface of said pusher confronting said wedge.

36. The method of claim 35 including arranging said curl motion of said pusher to curve down to a plane perpendicular to a bottom end of said wedge and to curve upward from said plane to proximity with said wedge.

37. The method of claim 32 including maneuvering said boom and said dipperstick to orient said log to extend away from said boom.

38. The method of claim 37 including lifting said log in engagement with said wedge before advancing said log onto said wedge to split said log.

* * * * *